US012222144B2

(12) United States Patent
Cluff

(10) Patent No.: US 12,222,144 B2
(45) Date of Patent: Feb. 11, 2025

(54) VARIABLE CAPACITY DEFROST

(71) Applicant: Carrier Corporation, Palm Beach Gardens, FL (US)

(72) Inventor: Charles A. Cluff, Zionsville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 295 days.

(21) Appl. No.: 17/865,002

(22) Filed: Jul. 14, 2022

(65) Prior Publication Data

US 2023/0013674 A1 Jan. 19, 2023

Related U.S. Application Data

(60) Provisional application No. 63/223,141, filed on Jul. 19, 2021.

(51) Int. Cl.

| | |
|---|---|
| ***F25B 47/02*** | (2006.01) |
| ***F24F 11/41*** | (2018.01) |
| ***F25B 49/02*** | (2006.01) |

(52) U.S. Cl.

CPC ..... *F25B 47/02* (2013.01); *F24F 11/41* (2018.01); *F25B 49/02* (2013.01); *F25B 2700/2103* (2013.01)

(58) Field of Classification Search

CPC ... F24F 11/41; F25B 2600/01; F25B 2600/23; F25B 2700/2103; F25B 2700/2116; F25B 47/02; F25B 49/02

See application file for complete search history.

(56) References Cited

U.S. PATENT DOCUMENTS

| | | | | |
|---|---|---|---|---|
| 4,604,872 | A | 8/1986 | Miyazaki et al. | |
| 4,850,200 | A | 7/1989 | Sugiyama | |
| 4,901,534 | A | 2/1990 | Nakatsuno et al. | |
| 5,538,072 | A * | 7/1996 | Burkhart | F25D 21/08 219/486 |
| 6,334,321 | B1 | 1/2002 | Said et al. | |
| 7,228,692 | B2 | 6/2007 | Concha et al. | |
| 8,417,386 | B2 | 4/2013 | Douglas et al. | |
| 9,068,771 | B2 | 6/2015 | Shah | |
| 9,829,237 | B2 | 11/2017 | Kang et al. | |
| 10,018,400 | B2 | 7/2018 | Qu et al. | |
| 10,024,589 | B2 | 7/2018 | Taki | |

(Continued)

FOREIGN PATENT DOCUMENTS

| | | |
|---|---|---|
| CN | 201772685 U | 3/2011 |
| CN | 102759237 A | 10/2012 |

(Continued)

*Primary Examiner* — Henry T Crenshaw

(74) *Attorney, Agent, or Firm* — CANTOR COLBURN LLP

(57) ABSTRACT

A method of performing a defrost operation in a heating, ventilation and air conditioning (HVAC) system having a first heat exchanger and a second heat exchanger, the method including determining that the defrost operation is needed; determining a capacity for the defrost operation in response to one or more prior defrost operations; beginning the defrost operation at the determined capacity; monitoring a defrost parameter; determining if the defrost parameter indicates a need for increased capacity; and increasing the capacity of the defrost operation when the defrost parameter indicates the need for increased capacity.

16 Claims, 3 Drawing Sheets

(56) References Cited

U.S. PATENT DOCUMENTS

| | | | | |
|---|---|---|---|---|
| 10,041,714 | B2 | 8/2018 | Kimura et al. | |
| 10,215,470 | B2 | 2/2019 | Nikaido et al. | |
| 10,544,958 | B2 | 1/2020 | Makino et al. | |
| 10,739,050 | B2 | 8/2020 | Shinozaki et al. | |
| 10,823,482 | B2 | 11/2020 | Chamoun et al. | |
| 10,889,163 | B2 | 1/2021 | Tada | |
| 2002/0139132 | A1* | 10/2002 | Collins | F25D 21/006 62/234 |
| 2005/0189431 | A1 | 9/2005 | Nakayama et al. | |
| 2012/0042667 | A1 | 2/2012 | Fulmer et al. | |
| 2012/0266621 | A1* | 10/2012 | Yokohara | F25B 47/022 62/155 |
| 2018/0238598 | A1* | 8/2018 | Xu | F25B 47/025 |
| 2021/0348817 | A1* | 11/2021 | Bates | F25B 47/006 |
| 2023/0013674 | A1* | 1/2023 | Cluff | F25B 47/02 |
| 2023/0204276 | A1* | 6/2023 | Ito | F25B 49/02 62/140 |

FOREIGN PATENT DOCUMENTS

| | | | |
|---|---|---|---|
| CN | 102933924 | A | 2/2013 |
| CN | 103906984 | A | 7/2014 |
| CN | 105674647 | A | 6/2016 |
| CN | 106016873 | A | 10/2016 |
| CN | 106152644 | A | 11/2016 |
| CN | 106322829 | A | 1/2017 |
| CN | 106595112 | A | 4/2017 |
| CN | 107076476 | A | 8/2017 |
| CN | 107084496 | A | 8/2017 |
| CN | 107560253 | A | 1/2018 |
| CN | 108692485 | A | 10/2018 |
| CN | 109579384 | A | 4/2019 |
| CN | 109668348 | A | 4/2019 |
| CN | 209371565 | U | 9/2019 |
| CN | 209386600 | U | 9/2019 |
| CN | 209819947 | U | 12/2019 |
| CN | 110701838 | A | 1/2020 |
| CN | 209944808 | U | 1/2020 |
| CN | 111336711 | A | 6/2020 |
| CN | 111707020 | A | 9/2020 |
| CN | 112229116 | A | 1/2021 |
| CN | 112413949 | A | 2/2021 |
| EP | 2853844 | A1 | 4/2015 |
| JP | 2822705 | B2 | 11/1998 |
| JP | 2009287794 | A | 12/2009 |

* cited by examiner

VARIABLE CAPACITY DEFROST

CROSS-REFERENCE TO RELATED APPLICATIONS

This application claims the benefit of Provisional Application No. 63/223,141 filed Jul. 19, 2021, the disclosure of which is incorporated herein by reference in its entirety.

BACKGROUND

The present disclosure relates to the field of heating, ventilation and air conditioning (HVAC) systems. More particularly, the present disclosure relates to performing defrost of a heat exchanger in an HVAC system.

HVAC systems, such as heat pumps, may employ a first heat exchanger (e.g., an indoor heat exchanger) and a second heat exchanger (e.g., an outdoor heat exchanger). In certain situations, frost can build up on the second heat exchanger. For example, in low ambient air temperatures during heating mode, the outdoor heat exchanger can experience a build up of frost, requiring a defrost operation. During the defrost operation, outdoor heat exchanger circuit temperatures can vary over a large range between the warmest and coldest circuits. Refrigerant flow into a heat exchanger may be divided among several circuits and then combined into a single flow after exiting the heat exchanger. A full defrost requires the coldest circuit to achieve a minimal margin above freezing (e.g., 40° F.) and in some cases this allows the warmest circuits to reach 75° F. or higher. During extreme cold ambient conditions (e.g., 0° F.), all circuits may experience significant cooling if wind is present. This cooling can delay defrost completion (e.g., a full defrost), indefinitely in some cases. This results in cold air being directed across the indoor heat exchanger for an excessive period of time.

BRIEF DESCRIPTION

According to an embodiment, a method of performing a defrost operation in a heating, ventilation and air conditioning (HVAC) system having a first heat exchanger and a second heat exchanger, includes determining that the defrost operation is needed; determining a capacity for the defrost operation in response to one or more prior defrost operations; beginning the defrost operation at the determined capacity; monitoring a defrost parameter; determining if the defrost parameter indicates a need for increased capacity; and increasing the capacity of the defrost operation when the defrost parameter indicates the need for increased capacity.

In addition to one or more of the features described herein, or as an alternative, further embodiments may include wherein determining the capacity for the defrost operation in response to one or more prior defrost operations includes determining that an increased capacity was used in one or more prior defrost operations.

In addition to one or more of the features described herein, or as an alternative, further embodiments may include wherein determining the capacity for the defrost operation in response to one or more prior defrost operations includes determining that one or more prior defrost operations was not completed within a defrost cycle time limit.

In addition to one or more of the features described herein, or as an alternative, further embodiments may include wherein determining the capacity for the defrost operation in response to one or more prior defrost operations includes determining that a rate of change of a temperature of the second heat exchanger was below a threshold in one or more prior defrost operations.

In addition to one or more of the features described herein, or as an alternative, further embodiments may include wherein determining the capacity for the defrost operation in response to one or more prior defrost operations includes determining that one or more prior defrost operations completed in less than a defrost cycle time limit.

In addition to one or more of the features described herein, or as an alternative, further embodiments may include wherein the defrost parameter includes one or more of time elapsed since initiating the defrost operation, a temperature of the second heat exchanger, a rate of change of the temperature of the second heat exchanger and a time remaining until a defrost cycle time limit.

In addition to one or more of the features described herein, or as an alternative, further embodiments may include wherein increasing the capacity of the defrost operation includes increasing the capacity of the defrost operation when the temperature of the second heat exchanger has not reached a desired level within a predetermined time of the defrost cycle time limit.

In addition to one or more of the features described herein, or as an alternative, further embodiments may include wherein increasing the capacity of the defrost operation includes increasing the capacity of the defrost operation when the rate of change of the temperature of the second heat exchanger is less than a desired level.

According to another embodiment, a heating, ventilation and air conditioning (HVAC) system includes a first heat exchanger; a second heat exchanger; a temperature sensor configured to sense a temperature of the second heat exchanger; a controller configured to execute operations including: determining that the defrost operation is needed; determining a capacity for the defrost operation in response to one or more prior defrost operations; beginning the defrost operation at the determined capacity; monitoring a defrost parameter; determining if the defrost parameter indicates a need for increased capacity; and increasing the capacity of the defrost operation when the defrost parameter indicates the need for increased capacity.

In addition to one or more of the features described herein, or as an alternative, further embodiments may include wherein determining the capacity for the defrost operation in response to one or more prior defrost operations includes determining that an increased capacity was used in one or more prior defrost operations.

In addition to one or more of the features described herein, or as an alternative, further embodiments may include wherein determining the capacity for the defrost operation in response to one or more prior defrost operations includes determining that one or more prior defrost operations was not complete within a defrost cycle time limit.

In addition to one or more of the features described herein, or as an alternative, further embodiments may include wherein determining the capacity for the defrost operation in response to one or more prior defrost operations includes determining that a rate of change of a temperature of the second heat exchanger was below a threshold in one or more prior defrost operations.

In addition to one or more of the features described herein, or as an alternative, further embodiments may include wherein determining the capacity for the defrost operation in response to one or more prior defrost operations includes determining that one or more prior defrost operations completed in less than a defrost cycle time limit.

In addition to one or more of the features described herein, or as an alternative, further embodiments may include wherein the defrost parameter includes one or more of time elapsed since initiating the defrost operation, a temperature of the second heat exchanger, a rate of change of the temperature of the second heat exchanger and a time remaining until a defrost cycle time limit.

In addition to one or more of the features described herein, or as an alternative, further embodiments may include wherein increasing the capacity of the defrost operation includes increasing the capacity of the defrost operation when the temperature of the second heat exchanger has not reached a desired level within a predetermined time of the defrost cycle time limit.

In addition to one or more of the features described herein, or as an alternative, further embodiments may include wherein increasing the capacity of the defrost operation includes increasing the capacity of the defrost operation when the rate of change of the temperature of the second heat exchanger is less than a desired level.

Technical effects of embodiments of the present disclosure include the ability to alter the capacity of a vapor compression cycle of an HVAC system prior to, and during, a defrost operation.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosure are presented herein by way of exemplification and not limitation with reference to the Figures.

Figure 1:
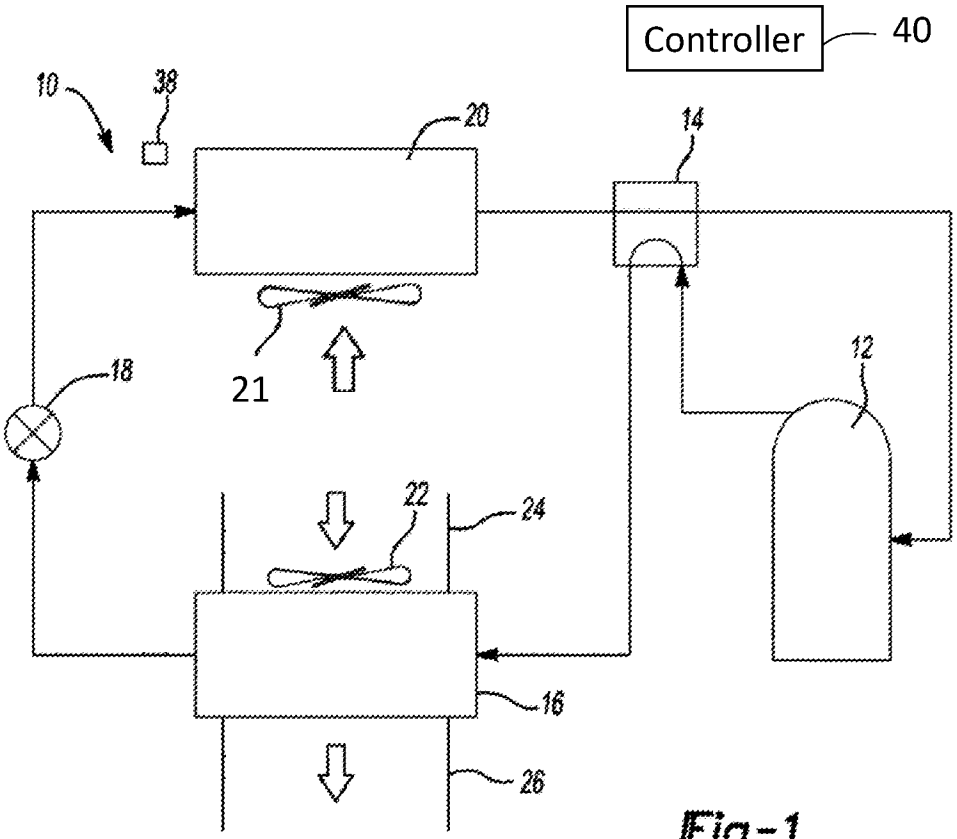
FIG. 1 depicts a heating, ventilation and air conditioning (HVAC) system in an example embodiment.

With reference to FIG. 1, a heating, ventilation and air conditioning HVAC system 10 (e.g., a heat pump) is depicted that may include a compressor 12, a reversing valve 14, a first heat exchanger 16 (e.g., an indoor heat exchanger), an expansion device 18 (e.g., a TXV or EEXV), and a second heat exchanger 20 (e.g., an outdoor heat exchanger). The compressor 12 can be a scroll compressor, a reciprocating compressor, or a rotary vane compressor, for example, or any other type of compressor. The reversing valve 14 may be a four-way valve operable to control a direction of working fluid (e.g., a refrigerant) flow through the HVAC system 10.

A controller 40 may switch the reversing valve 14 between a first position corresponding to a cooling mode and a second position corresponding to a heating mode (shown in FIG. 1). The controller 40 may also initiate a defrost operation as described herein. The controller 40 may be implemented using known devices, including a general purpose processor, digital signal processor (DSP), central processing unit (CPU), microcontroller, application-specific integrated circuit (ASIC), field-programmable gate array (FPGA), programmable logic device, discrete gate or transistor logic component, discrete hardware component, or the like. The controller 40 may also be in communication with the compressor 12, sensor 38, expansion valve 18, and other system components, as described in further detail herein.

In cooling, mode, the second heat exchanger 20 may operate as a condenser or as a gas cooler and may cool discharge-pressure working fluid received from the compressor 12 by transferring heat from the working fluid to ambient air, for example. In the heating mode, the second heat exchanger 20 may operate as an evaporator. A fan 21 may draw outside air across the second heat exchanger 20 to transfer heat between the working fluid in the second heat exchanger 20 and Me outside air. In the cooling mode, the first heat exchanger 16 may operate as an evaporator and may transfer heat from a space to be cooled (e.g., a room within a house or building) to the working fluid in the first heat exchanger 16.

In the heating mode, the first heat exchanger 16 may operate as a condenser or as a gas cooler and may transfer heat from working fluid discharged from the compressor 12 to a space to be heated. During operation of the HVAC system 10, a fan 22 may draw air from the space to be heated or cooled through a return-air duct 24 and force the air across the first heat exchanger 16 to transfer heat between the working fluid in the first heat exchanger 16 and the air. From the first heat exchanger 16, flue heated or cooled air may be forced through a supply-air duct 26 to the space to be heated or cooled.

The HVAC system 10 may include one or more sensors, including a second heat exchanger temperature sensor 38. The second heat exchanger temperature sensor 38 is in communication with the controller 40 and provides an indication of the need for, and status of, a defrost operation. The second. heat exchanger temperature sensor 38 may be installed on the second heat exchanger 20 to measure temperature (e.g., at a weakest section or circuit) of the second heat exchanger 20. The weakest circuit of the second heat exchanger 20 may be a portion of the circuit of the second heat exchanger 20 that receives the least heat transfer from the working fluid circulating in the second heat exchanger 20.

Figure 2:
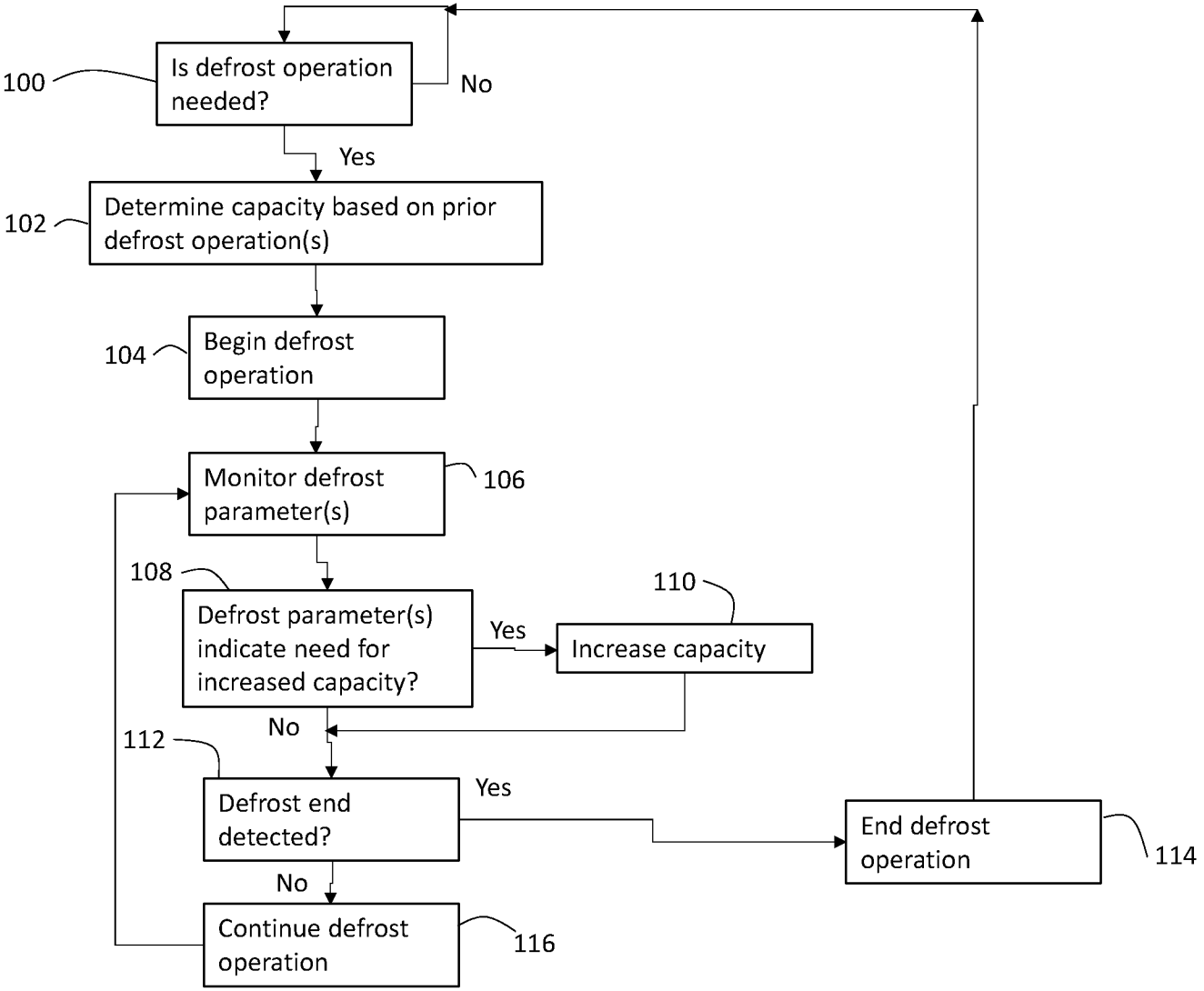
FIG. 2 depicts a flow diagram illustrating a process of performing a defrost operation in an example embodiment.

In heating mode, the second heat exchanger 20 may operate as an evaporator. In certain conditions, frost can build up on the second heat exchanger 20 requiring a defrost operation. FIG. 2 depicts a process of performing a defrost operation in an example embodiment. The process may be executed by the controller 40. The process begins at 100 where the controller 40 determines if a defrost operation is needed. The controller 40 monitors the temperature of the second heat exchanger 20 via second heat exchanger temperature sensor 38. If the temperature of the second heat exchanger 20 is below a threshold (e.g., 32° F.), optionally for a period of time, the controller 40 determines that a defrost operation is needed and the process flows to 102. Otherwise, the controller 40 continues to monitor the temperature of the second heat exchanger 20 until a defrost operation is needed.

At 102, the controller 40 determines a capacity for the defrost operation based on the results of one or more prior defrost operations. The capacity of the defrost operation corresponds to a capacity of the vapor compression cycle of the HVAC system. Capacity may be controlled by increasing/decreasing the speed of compressor 12, increasing/decreasing the number of cylinders employed in compressor 12 to compress the working fluid, activating/deactivating a second compressor in parallel or series with compressor 12, etc. The capacity of the vapor compression cycle may be described as increased or decreased with respect to a standard capacity corresponding to known operating conditions of the HVAC system (e.g., compressor speed, compressor stage used, etc.).

The controller 40 uses results from one or more prior defrost operations to determine the capacity to be used for the current defrost operation. For example, if the prior defrost operation used an increased capacity, then the current defrost operation will use the increased capacity. In another example, if the prior defrost operation was not complete within a defrost cycle time limit, then the current defrost operation will use an increased capacity. In another example, if the rate of change of the temperature of the second heat exchanger 20 was below, a threshold in a prior defrost operation, then the current defrost operation will use the increased capacity. In another example, if the prior defrost operation used an increased capacity and completed the defrost operation in less than the defrost cycle time limit, the current defrost operation will use a reduced capacity relative to the increased capacity. While these examples refer to a prior defrost operation, embodiments may use a statistical combination (e.g., mean, median, mode) of data from multiple prior defrost operations to set the capacity at 102.

Figure 3:
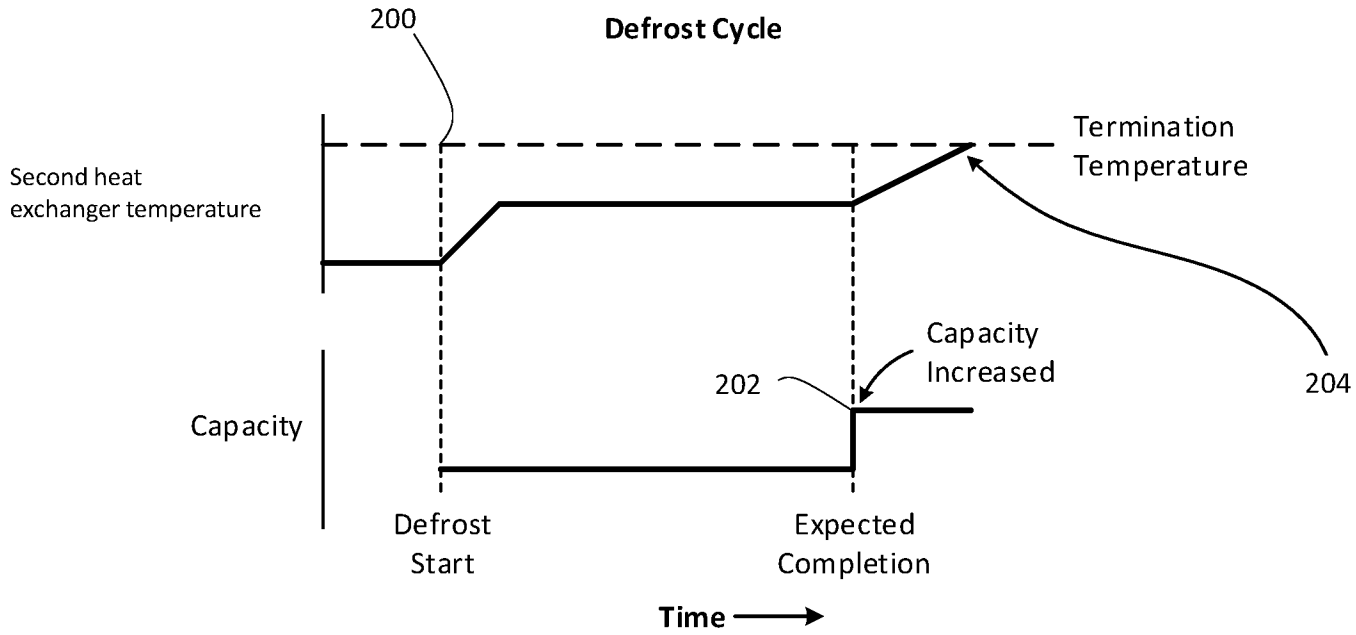
FIG. 3 depicts a graphical illustration of a relationship between temperature and vapor compression cycle capacity over time in an example embodiment.

At 104, the controller 40 begins the defrost operation at the capacity determined at 102. This typically involves setting the reversing valve 14 such that the working fluid from the outlet of the compressor 12 is directed to the second heat exchanger 20. This is illustrated in FIG. 3 as point 200. FIG. 3 depicts a relationship between temperature of the second heat exchanger 20 and vapor compression cycle capacity over time in an example embodiment.

At 106, the controller 40 monitors one or more defrost parameters as the defrost operation proceeds. The defrost parameters may include a variety of parameters including the time elapsed since initiating the defrost operation, the current temperature of the second heat exchanger 20, a rate of change of the temperature of the second heat exchanger 20, a time remaining until the defrost cycle time limit, etc.

At 108, the controller 40 determines, in response to the one or more defrost parameters, if capacity of the vapor compression cycle should be increased. This determination may be made in a variety of ways. In one example, the controller 40 monitors temperature of the second heat exchanger 20 and time remaining to the defrost cycle time limit. If the temperature of the second heat exchanger 20 has not reached a desired level (e.g., 35° F.) within a predetermined time (e.g., 3 minutes) of the defrost cycle time limit, the controller 40 will increase capacity of the vapor compression cycle as shown at 110. In another example, the controller 40 monitors a rate of change of the temperature of the second heat exchanger 20. If the rate of change of the temperature of the second heat exchanger 20 is less than a desired level, the controller 40 will increase capacity of the vapor compression cycle as shown at 110. The increase in capacity of the vapor compression cycle is depicted at 202 in FIG. 3.

At 112, the controller 40 determines if the defrost operation is completed. This may be performed by the controller 40 determining that the temperature of the second heat exchanger 20 has reached a termination temperature. This event is shown at 204 in FIG. 3. The defrost operation may be considered completed if the defrost cycle time limit is reached, regardless of temperature of the second heat exchanger 20. If the controller 40 determines the defrost operation is completed, flow proceeds to 114 where the defrost operation is terminated, after which the process flows to 100. If at 112 the controller 40 determines the defrost operation is not completed, flow proceeds to 116 where the defrost operation is continued.

Embodiments of the disclosure provide the ability to adjust capacity of a defrost operation both prior to starting the defrost operation and during the defrost operation. This reduces the duration of the defrost operation, which improves comfort for individuals in an area heated by the HVAC system.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of performing a defrost operation in a heating, ventilation and air conditioning (HVAC) system having a first heat exchanger and a second heat exchanger, wherein the defrost operation is performed on the second heat exchanger, the method comprising:

determining that the defrost operation is needed;

determining a capacity for the defrost operation in response to one or more prior defrost operations;

beginning the defrost operation at the determined capacity;

monitoring a defrost parameter;

determining if the defrost parameter indicates a need for increased capacity; and increasing the capacity of the defrost operation when the defrost parameter indicates the need for increased capacity.

2. The method of claim 1, wherein determining the capacity for the defrost operation in response to one or more prior defrost operations includes determining that an increased capacity was used in one or more prior defrost operations.

3. The method of claim 1, wherein determining the capacity for the defrost operation in response to one or more prior defrost operations includes determining that one or more prior defrost operations was not completed within a defrost cycle time limit.

4. The method of claim 1, wherein determining the capacity for the defrost operation in response to one or more prior defrost operations includes determining that a rate of change of a temperature of the second heat exchanger was below a threshold in one or more prior defrost operations.

5. The method of claim 1, wherein determining the capacity for the defrost operation in response to one or more prior defrost operations includes determining that one or more prior defrost operations were completed in less than a defrost cycle time limit.

6. The method of claim 1, wherein the defrost parameter includes one or more of time elapsed since initiating the defrost operation, a temperature of the second heat exchanger, a rate of change of the temperature of the second heat exchanger and a time remaining until a defrost cycle time limit.

7. The method of claim 6, wherein increasing the capacity of the defrost operation includes increasing the capacity of the defrost operation when the temperature of the second heat exchanger has not reached a desired level within a predetermined time of the defrost cycle time limit.

8. The method of claim 6, wherein increasing the capacity of the defrost operation includes increasing the capacity of the defrost operation when the rate of change of the temperature of the second heat exchanger is less than a desired level.

9. A heating, ventilation and air conditioning (HVAC) system comprising:

a first heat exchanger;

a second heat exchanger;

a temperature sensor configured to sense a temperature of the second heat exchanger;

a controller configured to execute defrost operations for the second heat exchanger including:

determining that the defrost operation is needed;

determining a capacity for the defrost operation in response to one or more prior defrost operations;

beginning the defrost operation at the determined capacity;

monitoring a defrost parameter, determining if the defrost parameter indicates a need for increased capacity; and increasing the capacity of the defrost operation when the defrost parameter indicates the need for increased capacity.

10. The HVAC system of claim 9, wherein determining the capacity for the defrost operation in response to one or more prior defrost operations includes determining that an increased capacity was used in one or more prior defrost operations.

11. The HVAC system of claim 9, wherein determining the capacity for the defrost operation in response to one or more prior defrost operations includes determining that one or more prior defrost operations was not complete within a defrost cycle time limit.

12. The HVAC system of claim 9, wherein determining the capacity for the defrost operation in response to one or more prior defrost operations includes determining that a rate of change of a temperature of the second heat exchanger was below a threshold in one or more prior defrost operations.

13. The HVAC system of claim 9, wherein determining the capacity for the defrost operation in response to one or more prior defrost operations includes determining that one or more prior defrost operations completed in less than a defrost cycle time limit.

14. The HVAC system of claim 9, wherein the defrost parameter includes one or more of time elapsed since initiating the defrost operation, a temperature of the second heat exchanger, a rate of change of the temperature of the second heat exchanger and a time remaining until a defrost cycle time limit.

15. The HVAC system of claim 14, wherein increasing the capacity of the defrost operation includes increasing the capacity of the defrost operation when the temperature of the second heat exchanger has not reached a desired level within a predetermined time of the defrost cycle time limit.

16. The HVAC system of claim 14, wherein increasing the capacity of the defrost operation includes increasing the capacity of the defrost operation when the rate of change of the temperature of the second heat exchanger is less than a desired level.

* * * * *